US009091102B2

(12) United States Patent
Krishnan

(10) Patent No.: US 9,091,102 B2
(45) Date of Patent: Jul. 28, 2015

(54) DUAL HOOD LATCH ASSEMBLY

(71) Applicant: FORD GLOBAL TECHNOLOGIES, LLC, Dearborn, MI (US)

(72) Inventor: Venkatesh Krishnan, Canton, MI (US)

(73) Assignee: Ford Global Technologies, LLC, Dearborn, MI (US)

( * ) Notice: Subject to any disclaimer, the term of this patent is extended or adjusted under 35 U.S.C. 154(b) by 266 days.

(21) Appl. No.: 13/675,459

(22) Filed: Nov. 13, 2012

(65) Prior Publication Data

US 2014/0132011 A1 May 15, 2014

(51) Int. Cl.

| | |
|---|---|
| ***E05C 3/06*** | (2006.01) |
| ***E05B 83/24*** | (2014.01) |
| ***E05B 79/20*** | (2014.01) |
| *E05C 3/16* | (2006.01) |

(52) U.S. Cl.

CPC ..... *E05B 83/247* (2013.01); *E05B 79/20* (2013.01); *Y10T 29/49826* (2015.01)

(58) Field of Classification Search

USPC ..... 292/217, DIG. 14, DIG. 42

See application file for complete search history.

(56) References Cited

U.S. PATENT DOCUMENTS

| | | | | |
|---|---|---|---|---|
| 3,026,132 | A | | 3/1962 | Korab et al. |
| 3,520,159 | A | * | 7/1970 | Swanney ..... 70/241 |
| 3,565,476 | A | | 2/1971 | Berman |
| 3,972,549 | A | | 8/1976 | Valade |
| 5,445,421 | A | | 8/1995 | Ferrara |

FOREIGN PATENT DOCUMENTS

| | | |
|---|---|---|
| GB | 2402961 | 12/2004 |
| WO | 9845559 | 10/1998 |

OTHER PUBLICATIONS

BMW 525 TDS E39 bonnet release mechanism, Red7Car Spares (2011).

Jay Bang and Jan Christian Thomas, Optimization of a Hood Latch System, Worcester Polytechnic Institute (Aug. 28, 2008).

* cited by examiner

*Primary Examiner* — Mark Williams

(74) *Attorney, Agent, or Firm* — Raymond Coppiellie; Price Heneveld LLP

(57) ABSTRACT

A motor vehicle dual hood latch mechanism for engaging a striker of a hood having a closed latched position and a released position is disclosed. The dual hood latch assembly includes a master latch and an auxiliary latch, each having a latching ratchet engaging a hood striker, and an intermediate cable extending between the latches adapted to unlatch the latching ratchet of the auxiliary latch in response to the latching ratchet of the master latch being unlatched.

14 Claims, 4 Drawing Sheets

DUAL HOOD LATCH ASSEMBLY

FIELD OF THE INVENTION

The present invention generally relates to hood latch assemblies for a motor vehicle, specifically dual hood latch assemblies that are released in series by a single release handle.

BACKGROUND OF THE INVENTION

Latch assemblies for motor vehicles are generally well-known in the art. In most motor vehicles, a hood is used to enclose the engine or luggage compartment of the motor vehicle. Such hoods are typically situated so as to be opened from the front of the vehicle and hinged along a rearward edge, such that the hood opens from the front of the vehicle. Such hoods have more recently been provided with dual hood latch assemblies that include a pair of strikers attached to the lower surface near the forward edge of the hood proximate opposite forward corners of the hood. Each of the pair of strikers is situated to interact with and to be restrained by a corresponding one of a pair of latch assemblies attached to the motor vehicle chassis, likewise located proximate the forward edge of the hood at opposite corners of the hood. A latch release handle is typically situated in the occupant compartment, usually near the driver's side kick panel or under the instrument panel. The handle is connected via a pair of bowden cables directly attached to a latch release lever operatively mounted on each of the pair of latch assemblies. Upon actuation of the hood release handle in the occupant compartment, the pair of bowden cables simultaneously pull on each of the latch release levers of each of the latch assemblies, thereby simultaneously releasing the strikers from the primary latch of each of the pair of latch assemblies.

However, dual hood latch assemblies experience certain drawbacks. For example, dual hood latch assemblies inherently suffer from significantly increased hood latch release efforts at the latch release handle inside the vehicle. Not only must the latch release handle operate against two spring assemblies, one in each of the pair of latch assemblies, but the additional length of the pair of bowden cables adds friction force to the handle effort. Also, in order to open both hood latch assemblies simultaneously, additional components and their associated costs and disadvantages are required, such as a splitter cable, to provide a parallel system that actuates each of the release levers on each of the pair of latch assemblies at the same time. The use of such splitter cables also inherently adds additional friction forces to the handle effort. There are further difficulties in routing the bowden cable within the engine compartment, contributing to longer bowden cable lengths and sharp or high angle bends in the cable, thus further increasing release handle efforts. Additional concerns have arisen regarding "snapback" of the hood release handle, particularly if the cable lengths from the splitter to each of the pair of latch assemblies are significantly different. Finally, in such systems, it is possible that only one of the pair of latch assemblies may release upon actuation of the hood release handle due to variations in cable length and kinks in the cable. Hence, a dual hood latch assembly which overcomes these drawbacks would be advantageous.

SUMMARY OF THE INVENTION

The hood latch deployment assembly disclosed herein particularly accomplishes the foregoing by adapting the present typical motor vehicle dual latch assemblies described above through a modification that can be applied to existing designs. The present invention takes advantage of existing structural configurations and alleviates the problems described above by creating a new and unique latching system. This is accomplished by arranging the existing dual latch assemblies in series, rather than in parallel, to create a master latch assembly and an auxiliary latch assembly. The energy released by releasing the master latch assembly, that is, the energy stored in the ratchet spring when the hood latch was placed in the closing position, actuates a second bowden cam connected to and for releasing the second auxiliary latch assembly. This arrangement significantly reduces the effort to overcome two spring assemblies to one spring assembly and reduces the length and function of the bowden cable operatively connected to the hood release handle. This arrangement also entirely eliminates the need for a cable splitter box. This arrangement also improves routing issues in the vehicle, since the latches are now in series and can be directly connected one to the other. "Snap-back" is also reduced, if not eliminated, because there are no unequal cable lengths being actuated. Finally, the possibility of opening only one of the pair of latches assemblies is eliminated, because actuation of the master latch assembly is certain to actuate the auxiliary latch assembly.

The solution includes a dual hood latch system for releasing a hood from a closed latched position to a released position, the system comprising a pair of strikers separately disposed proximate an edge of the hood, a master latch assembly and an auxiliary latch assembly, each attached to a chassis member of the motor vehicle and each adapted to engage one of the pair of strikers to restrain the hood in the closed latched position, each of the latch assemblies including a latch having a primary latching ratchet (sometimes also referred as a cam) and a pawl movable between a latched position where the primary latching ratchet engages the one of the pair of strikers to restrain the hood in the closed latched position, and an unlatched position where the primary latching ratchet is disengaged from the one of the pair of strikers to allow the hood to move to the released position, and a latch resilient member having an energized position and a released position and disposed to urge the primary latching ratchet to the unlatched position when in the released position, a master release cable operatively coupled at a distal end of the master release cable to the pawl of the master latch assembly and adapted to move the pawl of the master latch assembly to release the primary latching ratchet to the unlatched position when the master release cable is actuated, an intermediate release cable having a first end and a second end, the intermediate release cable being coupled at the second end to the pawl of the auxiliary latch assembly and adapted to move the pawl of the auxiliary latch assembly to release the primary latching ratchet of the auxiliary latch assembly to the unlatched position when the intermediate release cable is actuated, and an auxiliary release lever rotatably mounted on the master latch assembly and movable between a latched position and an unlatched position, the auxiliary release lever having a toggle end disposed adjacent to and adapted for selective displacement by a portion of the primary latching ratchet of the master latch assembly, a second end attached to the first end of the intermediate release cable, and a release lever resilient member urging the auxiliary release lever to the latched position, wherein movement of the latching ratchet of the master latch assembly to the unlatched position rotates the auxiliary release lever to the unlatched position to actuate the intermediate release cable.

A further aspect of the present invention is a dual hood latch system further comprising an occupant compartment within the motor vehicle and a master release handle disposed within the occupant compartment coupled to the master release cable for actuating the master release cable.

Another aspect of the invention is a dual hood latch system further comprising a secondary latch restraining the hood in a partial open position subsequent to movement of the primary latching ratchet to the unlatched position.

Still another aspect of the present invention is a dual hood latch system, wherein the latch resilient member comprises a torsion spring having a center spring coil, an upper leg extending from an upper portion of the center spring coil and a lower leg extending from a lower portion of the center spring coil.

Yet another aspect of the present invention is a dual hood latch system, wherein each of the master and auxiliary latch assemblies further comprise a latch engagement stud mounted to the primary latching ratchet for engagement with one of the legs of the torsion spring and a latch pivot bolt about which the latch rotates and about which the coil spring is mounted, wherein activation of the master release cable releases the primary latching ratchet of the master latch assembly and actuation of the intermediate release cable releases the primary latching ratchet of the auxiliary latch assembly.

An additional aspect of the present invention is a dual hood latch system, wherein one of the legs of the torsion spring also acts directly on the latch engagement stud to rotate the primary latching ratchet and place the hood in the released position.

Another aspect of the present invention is a dual hood latch system, further comprising a secondary release latch restraining the hood at a partial open position.

A further aspect of the present invention is a dual hood latch assembly for a motor vehicle comprising a master latch and an auxiliary latch, each having a latching ratchet having a latched and an unlatched position engaging a hood striker, and an intermediate cable extending between the latches adapted to move the latching ratchet of the auxiliary latch to the unlatched position in response to the latching ratchet of the master latch moving to the unlatched position.

Yet a further aspect of the present invention is a dual hood latch assembly, wherein each of the master and auxiliary latches are attached to a chassis member of the motor vehicle and each are adapted to engage one of a pair of strikers to restrain the hood in the closed latched position, each of the latch assemblies including a latch having a latching ratchet and a pawl movable between a latched position where the latching ratchet engages one of the pair of strikers to restrain the hood in the closed latched position, and an unlatched position where the latching ratchet is disengaged from one of the pair of strikers to allow the hood to move to the released position, and a latch resilient member having an energized position and a released position and disposed to urge the latching ratchet to the unlatched position when in the released position Yet a further aspect of the present invention is a dual hood latch assembly, further comprising a master release cable operatively coupled at a distal end of the master release cable to the pawl of the master latch assembly and adapted to move the pawl of the master latch assembly to release the latching ratchet to the unlatched position when the master release cable is actuated.

A still further aspect of the present invention is a dual hood latch assembly, further comprising an intermediate release cable having a first end and a second end, the intermediate release cable being coupled at the second end to the pawl of the auxiliary latch assembly and adapted to move the pawl of the auxiliary latch assembly to release the latching ratchet of the auxiliary latch assembly to the unlatched position when the intermediate release cable is actuated.

Yet another aspect of the present invention is a dual hood latch mechanism, further comprising an auxiliary release lever rotatably mounted on the master latch assembly and movable between a latched position and an unlatched position, the auxiliary release lever having a toggle end disposed adjacent to and adapted for selective displacement by a portion of the latching ratchet of the master latch assembly, a second end attached to the first end of the intermediate release cable, and a release lever resilient member urging the auxiliary release lever to the latched position, wherein movement of the latching ratchet of the master latch assembly to the unlatched position rotates the auxiliary release lever to the unlatched position to actuate the intermediate release cable.

Another aspect of the present invention is a dual hood latch assembly, further comprising an occupant compartment and a master release handle disposed within the occupant compartment coupled to the master release cable for actuating the master release cable and unlatching the master latch.

A yet additional aspect of the present invention is a dual hood latch assembly, wherein each of the master latch and the auxiliary latch comprise a spring urging each of the latching ratchets to the unlatched position when the master release handle is actuated.

A further aspect of the present invention is a dual hood latch assembly, wherein the spring comprises a torsion spring having a center spring coil, an upper leg extending from an upper portion of the center spring coil and a lower leg extending from a lower portion of the center spring coil.

A still further aspect of the present invention is a dual hood latch assembly, wherein each of the latching ratchets of the master and auxiliary latches further comprise a latch engagement stud mounted to the latching ratchet for engagement with one of the legs of the torsion spring and a latch pivot bolt about which the latching ratchet rotates and about which the coil spring is mounted, wherein activation of the master release handle releases the latching ratchet of the master latch and actuation of the intermediate cable releases the primary latching ratchet of the auxiliary latch assembly.

Another aspect of the present invention is a dual hood latch assembly, wherein each of the master and auxiliary latches further comprise a secondary latch restraining the hood in a partial open position following movement of the latching ratchet to the unlatched position.

According to another aspect of the present invention is a method of latching the hood of a motor vehicle having a pair of strikers disposed proximate an edge of a hood and having a closed latched position and a released position, the method comprising the steps of attaching a master latch assembly and an auxiliary latch assembly to a chassis member of the motor vehicle, where each of the master and auxiliary latch assemblies are adapted to releasably engage one of the pair of strikers to restrain the hood in the closed latched position, each of the latch assemblies including a latch having a primary latching ratchet and a pawl movable between a latched position where the primary latching ratchet engages the one of the pair of strikers to restrain the hood in the closed latched position, and an unlatched position where the primary latching ratchet is disengaged from the one of the pair of strikers to allow the hood to move to the released position, and a latch resilient member having an energized position and a released position and disposed to urge the primary latching ratchet to the unlatched position when in the released position, operatively coupling a master release cable at a distal end to the pawl of the master latch assembly and moving the pawl of the master latch assembly to release the primary latching ratchet to the unlatched position when the master release cable is actuated, extending an intermediate release cable having a first end and a second end between the master and auxiliary latches, coupling the intermediate release cable at the second end to the pawl of the auxiliary latch assembly and moving the pawl of the auxiliary latch assembly to release the primary latching ratchet of the auxiliary latch assembly to the unlatched position when the intermediate release cable is actuated, and rotatably mounting an auxiliary release lever on the master latch assembly for movement between a latched position and an unlatched position, the auxiliary release lever having a toggle end disposed adjacent to and adapted for selective displacement by a portion of the primary latching ratchet of the master latch assembly, a second end attached to the first end of the intermediate release cable, and a release lever resilient member urging the auxiliary release lever to the latched position, wherein movement of the latching ratchet of the master latch assembly to the unlatched position rotates the auxiliary release lever to the unlatched position to actuate the intermediate release cable.

Still another aspect of the present invention is a method of latching the hood of a motor vehicle, wherein the latch resilient member comprises a torsion spring having a center spring coil, an upper leg extending from an upper portion of the center spring coil and a lower leg extending from a lower portion of the center spring coil.

Yet another aspect of the present invention is a method of latching the hood of a motor vehicle, wherein each of the master and auxiliary latch assemblies further comprise a latch engagement stud mounted to the primary latching ratchet for engagement with one of the legs of the torsion spring and a latch pivot bolt about which the latch rotates and about which the coil spring is mounted, wherein activation of the master release cable releases the primary latching ratchet of the master latch assembly and actuation of the intermediate release cable releases the primary latching ratchet of the auxiliary latch assembly.

A further aspect of the present invention is a method of latching the hood of a motor vehicle, further comprising the step of disposing a master release handle within an occupant compartment and coupled the master release handle to the master release cable for actuating the master release cable and unlatching the master latch.

Thus, the solution presented by the present disclosure is are relatively low-cost dual latch assemblies where the primary latch of the master latch assembly is directly connected to the manual release handle through a master release cable. The latching ratchet of the master latch assembly, when released by the master release cable, engages a lever which pulls an intermediate release cable extending between the master latch assembly and the auxiliary latch assembly to release the latching ratchet of the auxiliary latch assembly. The energy for the present invention is obtained from present latch assemblies that utilize springs having the capacity to store very high levels of potential energy. Indeed, such springs presently attached to the latching ratchet urge the latching ratchet to overcome the weight of the hood and urge the hood up to a secondary latching position, where the customer may reach into the opening and operate the secondary latch handle to fully open the hood. Such high energy springs are also capable to release the latching ratchet of the auxiliary latch assembly. As a result, decreased efforts at the master hood release handle (up to 40%) can released, fewer components are required, and better routing and less cable length are required.

These and other aspects, objects, and features of the present invention will be understood and appreciated by those skilled in the art upon studying the following specification, claims, and appended drawings.

DETAILED DESCRIPTION OF THE PREFERRED EMBODIMENTS

Figure 1:
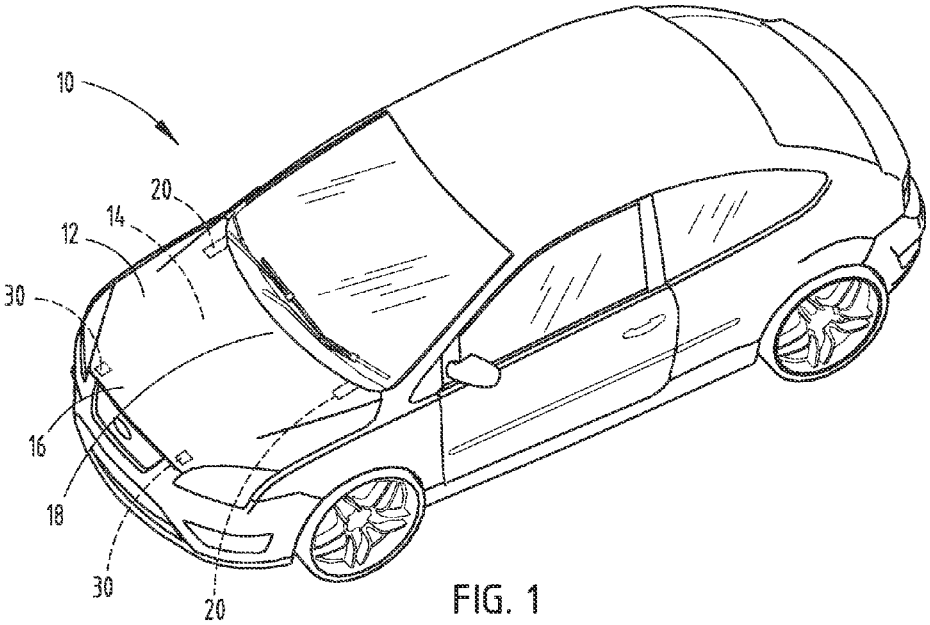
FIG. 1 is a perspective view of a motor vehicle incorporating the dual hood latch assembly in accordance with the present invention.

For purposes of description herein, the terms "upper," "lower," "right," "left," "rear," "front," "vertical," "horizontal," and derivatives thereof shall relate to the invention as oriented in FIG. 1. However, it is to be understood that the invention may assume various alternative orientations and step sequences, except where expressly specified to the contrary. It is also to be understood that the specific devices and processes illustrated in the attached drawings, and described in the following specification, are simply exemplary embodiments of the inventive concepts defined in the appended claims. Hence, specific dimensions and other physical characteristics relating to the embodiments disclosed herein are not to be considered as limiting, unless the claims expressly state otherwise.

Vehicle 10 includes a hood 12 covering an engine compartment 14. Hood 12 is generally formed as a panel having a forward edge 16 and a rearward edge 18. Hood 12 may be connected to the body of the vehicle 10 by hinges 20. In the closed position shown in FIGS. 1, 2, and 3, hood 12 is disposed adjacent and extends across an opening 22 in the body of vehicle 10, providing access to the engine compartment 14. Hood 12 is releasably connected to the vehicle body 10 by a pair of latch assemblies 30 and is pivotable relative to the vehicle body to move between an open position and a closed position.

In the described example, it is assumed that the latch assemblies 30 are located adjacent the forward edge 16 of the hood and the hinges 20 are located at the rear edge 18 of hood 12. However, it is also possible to perform the functions of this invention while positioning the hinges adjacent the leading edge of the hood and the latch mechanisms adjacent the trailing edge of the hood.

Figure 2:
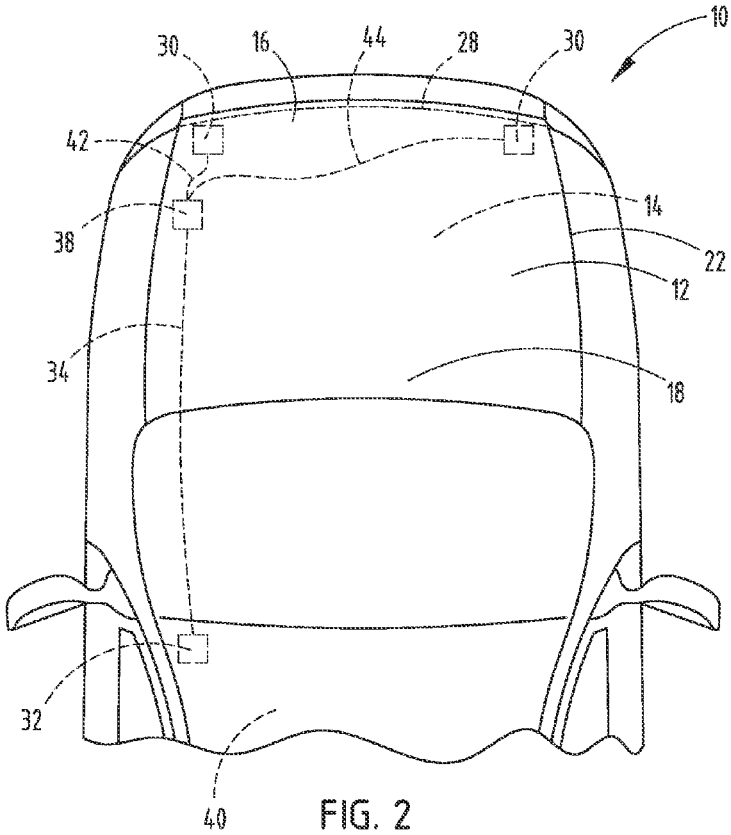
FIG. 2 PRIOR ART
FIG. 2 is a top plan view of a motor vehicle incorporating a dual hood latch assembly in accordance with a prior art parallel release arrangement.
Figure 4:
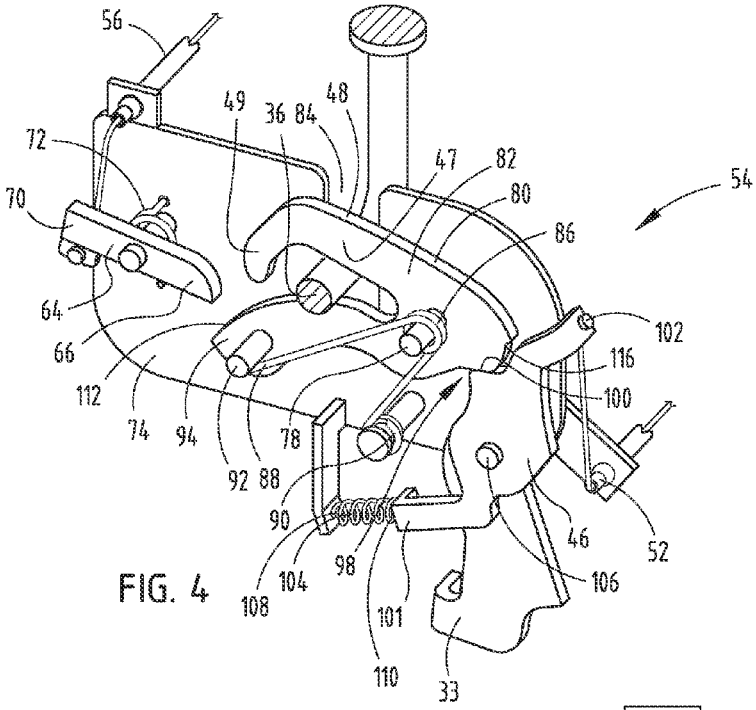
FIGS. 4-4A are perspective and front plan views, respectively, of an embodiment of the dual hood latch assembly of the present invention in the latched position.
Figure 5:
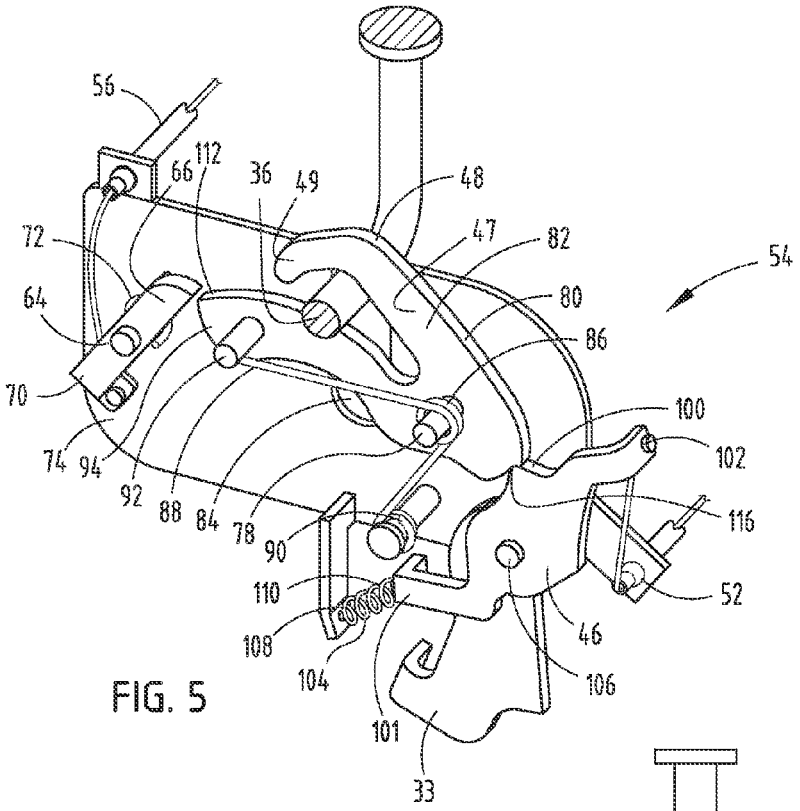
FIGS. 5-5A are perspective and front plan views, respectively, of an embodiment of the dual hood latch assembly of the present invention in the unlatched position.
Figure 5A:
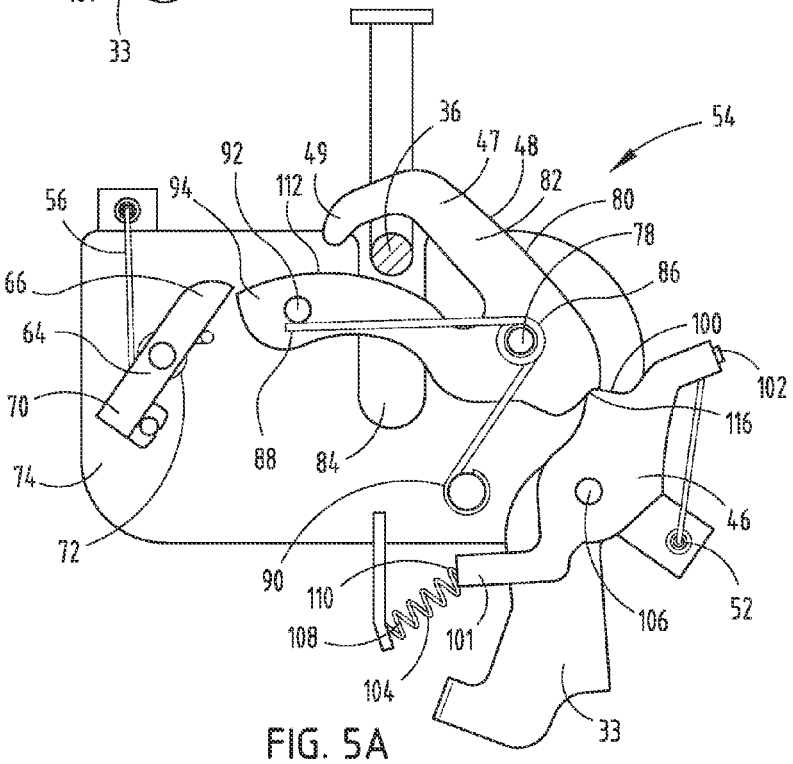

Referring now to FIG. 2, dual hood latch assemblies 30 are shown, as the trend currently in the automotive industry is to provide a pair of identical hood latch assemblies 30 that each engages one of a pair of strikers 36, shown in detail in FIGS. 4-5A, attached to the lower surface near the forward edge 16 of the hood 12 proximate opposite corners of the hood 12, as shown. Each one of the pair of strikers 36 is situated to interact with and to be restrained by a primary latch arm 47 of a latching ratchet 48, also shown in detail in FIGS. 4-5A, of a corresponding one of a pair of latch assemblies 30 attached to the motor vehicle chassis 28, likewise located proximate the forward edge 16 of the hood 12 at opposite corners of the hood 12. As best shown in FIGS. 4-5A, each of the latch assemblies 30 is provided with a release pawl 46 that is situated to release the latching ratchet 48 for rotational motion upon the urging of a torsional spring 50, as described below.

A secondary latch arm is also typically provided in such latch assemblies 30. Such secondary latch arms are manually operated from the front of the vehicle, such that in the event of an inadvertent release of the latching ratchet 48 and the primary latch arm 47 or failure of the primary latch ratchet cam 48 while the vehicle is in motion, the hood 12 will not abruptly raise due to wind pressure. Rather, release of the secondary latch arm requires a person standing in front of the vehicle 10 to manually operate the secondary latch handle (not shown) in order to release the secondary latch arm from one of the pair of strikers. This allows the hood to be fully raised, providing access to the engine in the engine compartment 14 and/or luggage within the luggage compartment. In the some configurations, a secondary latch arm is attached to only one of the latch assemblies 30.

A primary hood latch release handle 32 is typically situated in the occupant compartment or passenger cabin 40, usually near the driver's side kick panel or under the instrument panel. The primary hood release handle 32 is connected via a common bowden cable 34 to a cable splitter box 38, usually located in the engine compartment 14. A first hood latch release cable 42 and a second hood latch release cable 44 extend from the cable splitter box and are mechanically coupled with the common bowden cable 34. The first hood latch release cable 42 is attached to the latch release pawl 46 of one of the latch assemblies 30 and the second hood latch release cable 44 is attached to the latch release pawl 46 of the other one of the latch assemblies 30. Upon actuation of the primary hood release handle 32 in the occupant compartment 40, the common bowden cable 34 simultaneously pulls on each of the first and second hood latch release cables 42, 44, thus placing the latch release pawl 46 in a release position, and thereby unlatching the latching ratchet 46 and simultaneously releasing the strikers 36 from the latching ratchet 46 of each of the pair of latch assemblies 30.

Such dual hood latch assemblies 30, however, suffer from significantly increased hood latch 30 release efforts at the primary hood latch release handle 32 inside the vehicle 10. First, the primary hood latch release handle 32 must overcome the force of two release pawl spring assemblies 104, one in each of the pair of latch assemblies 30. Second the primary hood latch release handle 32 must overcome the frictional force created by the additional length of the pair of bowden cables 34, 42, 44. Also, in order to open both hood latch assemblies 30 simultaneously, the additional of the cable splitter box 38 and associated components, as well as their associated costs, are required. The use of the cable splitter box 38 and cables 42, 44 also adds friction forces to the release handle 32 effort. As noted above, routing the bowden cables 34, 42, 44 can be problematic, particularly where longer bowden cable lengths and sharp bends in the cables 34, 42, 44 are required, further increasing release handle 32 effort. Additionally, "snapback" of the primary hood latch release handle 32 can occur due to the unequal cable lengths of the first and second hood release cables 42, 44 from the splitter to each of the pair of latch assemblies 30. Finally, the chance may exist that only one of the pair of latch assemblies 30 may release upon actuation of the primary hood latch release handle 32 due to variations in cable length and kinks in the cables 42, 44.

Figure 3:
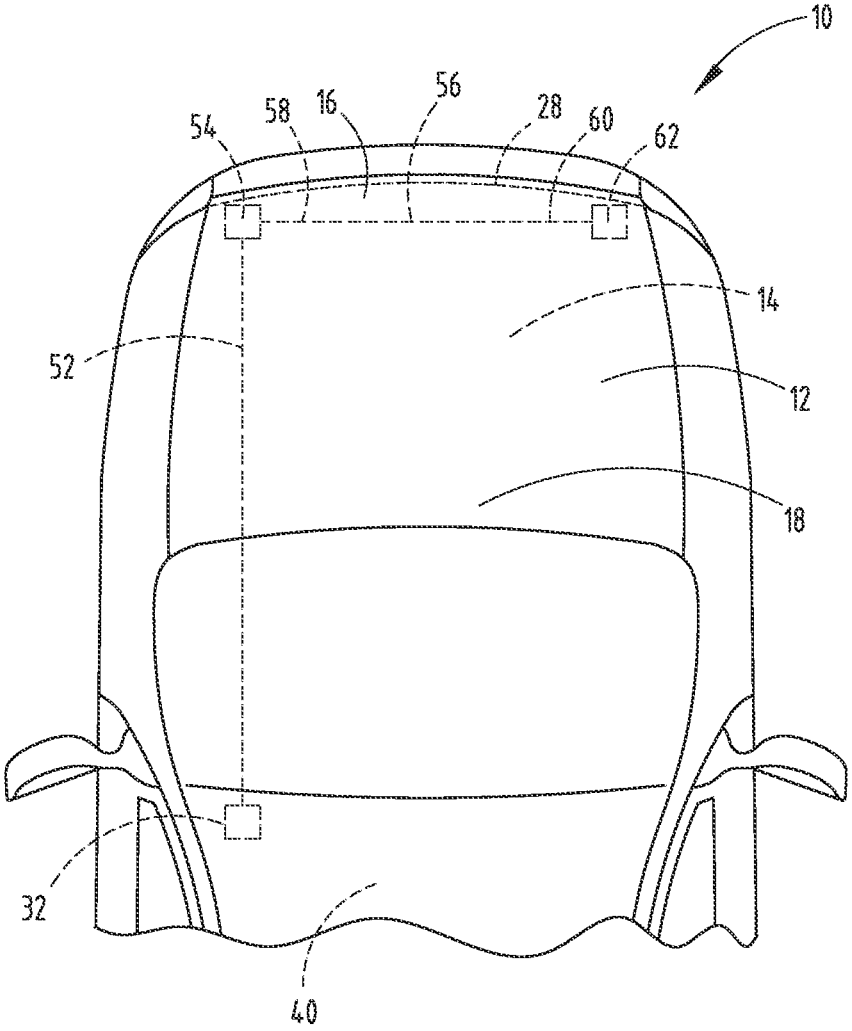
FIG. 3 is a top plan view of a motor vehicle incorporating an embodiment of the dual hood latch assembly of the present invention.

As shown in FIG. 3, an embodiment of the dual latch assembly of the present invention is shown, which overcomes each of the drawbacks discussed above. The primary hood latch release handle 32 is likewise situated in the occupant compartment or passenger cabin 40. As further shown in FIGS. 4-5A, the primary hood latch release handle 32, however, is connected via a master release cable 52 directly to the latch release pawl 46 of a master latch assembly 54. Upon actuation of the primary hood latch release handle 32 in the occupant compartment 40, the master release cable 52 pulls on the latch release pawl 46 of the master latch assembly 54 to place the same in a release position, thereby unlatching the latching ratchet 46 of the master latch assembly 54 and releasing one of the pair of the strikers 36 from the latching ratchet 48 of the master latch assembly 54.

Referring again to FIG. 3, an intermediate release cable 56, having a first end 58 and a second end 60, is coupled at its second end 60 to the release pawl 46 of an auxiliary latch assembly 62 mounted on the other side of the vehicle 10. The intermediate release cable 56 thus is adapted to move the release pawl 46 of the auxiliary latch assembly 62 to release the primary latch arm 47 of the latching ratchet 48 of the auxiliary latch assembly 62 to the unlatched position when the intermediate release cable 56 is actuated. An auxiliary release lever 64 is rotatably mounted on the master latch assembly 54, as best shown in FIGS. 4-5A, and is movable between a latched position and an unlatched position. The auxiliary release lever 64 has a toggle end 66 disposed adjacent to a lower leg 94 of the latching ratchet 48 of the master latch assembly 54. A second end 70 of the auxiliary release lever 64 is attached to the first end 58 of the intermediate release cable 56. A release lever centering spring 72 urges the auxiliary release lever 64 clockwise to the latched position. However, upon clockwise rotation of the latching ratchet 48 of the master latch assembly 54, to the unlatched position, the lower leg 94 of the latching ratchet 48 strikes the toggle end 66 of the auxiliary release lever 64 to rotate the auxiliary release lever 64 counterclockwise to the unlatched position to actuate the intermediate release cable 56. Upon actuation of the intermediate release cable 56, the latch release pawl 46 of the auxiliary latch assembly 62 is placed in a released position, thereby unlatching the latching ratchet 48 of the auxiliary latch assembly 62 and releasing the other of the pair of the strikers 36 from the latching ratchet 48 of the auxiliary latch assembly 62.

Figure 4A:
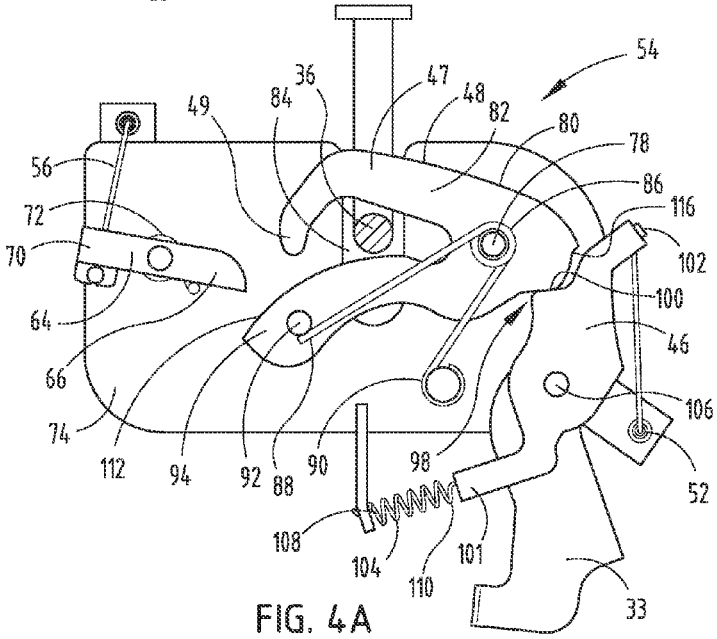

The master latch assembly 54 is shown in FIGS. 4-5A. Unless otherwise noted, the master latch assembly 54 is identical in construction to the auxiliary latch assembly 62. The only difference is that the tab 64 and related components are not present in the auxiliary latch. The master latch assembly 54 includes a housing or bracket 74 attached via mounting holes 76 to a front chassis member or base via fasteners (not shown) extending transverse parallel to the lateral axis of the motor vehicle, as is well-known in the art. The master latch assembly 54 interacts with the striker 36 disposed on the forward edge 16 of the hood 12 relative to the motor vehicle 10. The hood 12 has a closed latched position, a released position, and an open position. In the closed latched position, shown in FIGS. 4 and 4A, the hood 12 cannot be raised and is restrained in place by the master latch assembly 54 and the auxiliary latch assembly 62, each capturing and restraining one of a pair of striker 36.

As shown in FIGS. 5 and 5A, the latching ratchet 48 rotates around a latch pivot bolt 78. The latching ratchet 48 is provided with an upper leg 80 that includes a transverse portion 82 that extends upwardly and away from a channel 84 provided in the latch bracket 74 for engaging and capturing the striker 36 of the hood 12. A torsion spring 86 is preferably mounted about the pivot bolt 78 of the master latch assembly 54. The torsion spring 86 has an upper leg 88 and lower leg 90. The upper leg 88 is disposed adjacent a latch engagement stud 92 mounted on a lower latch 94 of the latching ratchet 48, while the lower leg 66 is restrained in a lower notch 96 in the bracket 74. The torsion spring 86 thus urges the latching ratchet 48 into a clockwise rotation (as shown in FIGS. 4-5A) about latch pivot bolt 78, causing the latching ratchet 48 to rotate from the closed latched position to the unlatched position.

The latching ratchet 48 of the master latch assembly 54 is also provided with a pawl engaging tab 98 for engaging a latching ratchet engaging surface 100 of the latch release pawl 46. The distal end 102 of pawl 46 is connected to the master bowden cable 52 in the manner described above. The latching ratchet engaging surface 100 of the latch release pawl 46 is urged into contact with the pawl engaging tab 98 of the latching ratchet 48 by pawl spring 104 acting on latch release pawl 46 to urge the latch release pawl 46 to rotate clockwise about latch release pawl pivot 106. The torsion spring 86 acts on latching ratchet 48 to rotate the latching ratchet 48 138 clockwise, as best seen in FIGS. 4-5A. As shown, pawl compression spring 104 has a first end 108 attached to the bracket 74 and an opposite second end 110 attached to an opposite distal end 101 of the latch release pawl 46 and urges the latch release pawl 46 in the counterclockwise direction.

In operation, actuation of the master bowden cable 52 causes the pawl 46 to rotate about pawl pivot 106, against the force of pawl compression spring 104, in a clockwise direction to release the cam engaging surface 100 from the pawl engaging tab 98 of the latching ratchet 48, as shown in FIGS. 5-5A. With the latching ratchet 48 now free to rotate under the urging the torsion spring 86, an arcuate bottom surface 112 of the lower leg 94 of the latching ratchet 48 urges the striker 36 upwardly within the channel 84. Once the striker 36 reaches the top of the channel 84, and is essentially free of the primary latch arm 47 of the latching ratchet 48. As noted above, the vehicle operator must then go to the front of the vehicle and further manually operate the secondary latch handle (not shown) to release the secondary latch arm and allow the hood to be raised.

Only the master latch assembly has 54 is provided with the auxiliary release lever 64. As the latching ratchet 48 of the master latch assembly 54 rotates to the unlatched position, to leg 94 of the latching ratchet 48 strikes the toggle end 66 of the auxiliary release lever 64 to move the auxiliary release lever to the unlatched position to actuate the intermediate release cable 56. Upon actuation of the intermediate release cable 56, the latch release pawl 46 of the auxiliary latch assembly 62 is placed in a released position as described above for the master latch assembly 54, unlatching the latching ratchet 46 of the auxiliary latch assembly 62 and releasing the other of the pair of the strikers 36 from the latching ratchet 48 of the auxiliary latch assembly 62.

Closing the hood 12 resets the latching ratchet 48 against the urging of the torsion springs 86 of each of the master latch assembly 54 and the auxiliary latch assembly 62. The pawl engaging tab 98 and cam engaging surface 100 are thus brought into engagement to lock the latching ratchets 48 in place and store significant potential energy in the deformed torsion spring 86. Given that the torsion springs 86 are required to raise and hold up the hood and prevent it from closing on its own weight, the torsion spring is very strong. Similarly, the release lever 64, and intermediate release cable 56 are returned to their initial, latched position by torsion spring 72.

As can be appreciated from the forgoing, actuation of the primary hood latch release handle 32 in the occupant compartment 40 directly activates only the master latch assembly 54. When released, the master latch assembly 54 releases the energy stored in the master latch assembly 54 torsion spring 86, which in turn is used to independently trigger the release of the auxiliary latch assembly 62 through the intermediate cable 56. This effectively allows use of the latching ratchet 48 of the master latch assembly 54 to activate the auxiliary latch assembly 62 using the potential energy of the torsion spring 86 to toggle the auxiliary release lever 64.

As a consequence, the effort necessary to actuate the primary hood latch release handle 32 is significantly reduced, in some cases by about 40%, compared to a parallel system described above. This reduction in force is from several sources. First, the force necessary to overcome two pawl springs 104 is reduced to one pawl spring 104. Second, the shorter distance of the master bowden cable, compared to a parallel system, creates less friction force at the hood latch release handle 32, where the primary hood latch release handle 32 efforts equals the length of the cable times the friction force per unit length of the cable. Also, since the travel of the latching ratchet 48 is greater than the travel of the pawl 46, the cable distance necessary to displace the auxiliary release lever 64 is reduced.

The present invention further improves cable routing issues, particularly under the hood 12, reducing tight turns and its associated friction forces. The present invention also eliminates the need for a splitter box, representing a simpler design and lower cost. The independent release of the master latch assembly 54 and the auxiliary latch assembly 62 eliminates the potential of only the master latch assembly 54 unlatching, as may occur in the parallel systems discussed above. Rather, a single pull of the primary hood latch release handle 32 sequentially, and independently, releases both latches. In accordance with the present invention, only the master latch assembly 54 is released by the primary hood latch release handle 32. The potential energy released in master latch assembly 54 by the release of its latching ratchet 48 in turn separately and independently releases the auxiliary latch assembly 62. The auxiliary latch assembly 62 is not directly released by the primary hood latch release handle 32. Thus, an in-series system using the release of the master latch assembly 54 to release the auxiliary latch assembly 62 is disclosed.

It is to be understood that variations and modifications can be made on the aforementioned structure without departing from the concepts of the present invention, and further it is to be understood that such concepts are intended to be covered by the following claims unless these claims by their language expressly state otherwise.

I claim:

1. A dual hood latch system adapted for releasing a hood of a motor vehicle from a closed latched position relative one or more chassis members of the motor vehicle to a released position, said dual hood latch system comprising:

a pair of strikers separately disposed proximate an edge of the hood:

a master latch assembly and an auxiliary latch assembly, each attached to one of the chassis members of the motor vehicle and each adapted to engage one of the pair of strikers to restrain the hood in the closed latched position, each of the latch assemblies including a latch having a primary latching ratchet and a pawl movable between a latched position where the primary latching ratchet engages the one of the pair of strikers to restrain the hood in the closed latched position, and an unlatched position where the primary latching ratchet is disengaged from the one of the pair of strikers to allow the hood to move to the released position, and a latch resilient member having an energized position and a released position and disposed to urge the primary latching ratchet to the unlatched position when in the released position;

a master release cable operatively coupled at a distal end of the master release cable to the pawl of the master latch assembly and adapted to move the pawl of the master latch assembly to release the primary latching ratchet to the unlatched position when the master release cable is actuated;

an intermediate release cable having a first end and a second end, the intermediate release cable being coupled at the second end to the pawl of the auxiliary latch assembly and adapted to move the pawl of the auxiliary latch assembly to release the primary latching ratchet of the auxiliary latch assembly to the unlatched position when the intermediate release cable is actuated; and an auxiliary release lever rotatably mounted on the master latch assembly and movable between a latched position and an unlatched position, the auxiliary release lever having a first toggle end disposed adjacent to and adapted for selective displacement by a portion of the primary latching ratchet of the master latch assembly, a second end of the auxiliary release lever attached to the first end of the intermediate release cable, and a release lever resilient member urging the auxiliary release lever to the latched position, wherein movement of the latching ratchet of the master latch assembly to the unlatched position rotates the auxiliary release lever to the unlatched position to actuate the intermediate release cable.

2. The dual hood latch system of claim 1 further comprising an occupant compartment within the motor vehicle and a master release handle disposed within the occupant compartment coupled to the master release cable for actuating the master release cable.

3. The dual hood latch system of claim 1 further comprising a secondary latch restraining the hood in a partial open position subsequent movement of the primary latching ratchet to the unlatched position.

4. The dual hood latch system of claim 1, wherein the latch resilient member comprises a torsion spring having a center spring coil, an upper leg extending from an upper portion of the center spring coil and a lower leg extending from a lower portion of the center spring coil.

5. The dual hood latch system of claim 4, wherein each of the master and auxiliary latch assemblies further comprise a latch engagement stud mounted to the primary latching ratchet for engagement with one of the legs of the torsion spring and a latch pivot bolt about which the latch rotates and about which the coil spring is mounted, wherein activation of the master release cable releases the primary latching ratchet of the master latch assembly and actuation of the intermediate release cable releases the primary latching ratchet of the auxiliary latch assembly.

6. The dual hood latch system of claim 5, wherein the one of the legs of the torsion spring also acts directly on the latch engagement stud to rotate the latch and place the hood in the released position.

7. The dual hood latch system of claim 3 further comprising a secondary release latch restraining the hood at a partial open position.

8. A dual hood latch assembly for a motor vehicle having a hood and one or more chassis members proximate the hood, said dual hood latch assembly comprising:

a master latch and an auxiliary latch, each having a latching ratchet having a latched and an unlatched position engaging a hood striker mounted on the hood, wherein each of the master and auxiliary latches are attached to one of the chassis members of the motor vehicle and each are adapted to engage one of a pair of strikers to restrain the hood in the closed latched position, each of the latch assemblies including a latch having a latching ratchet and a pawl movable between a latched position where the latching ratchet engages the one of the pair of strikers to restrain the hood in the closed latched position, and an unlatched position where the latching ratchet is disengaged from the one of the pair of strikers to allow the hood to move to the released position a latch resilient member having an energized position and a released, position and disposed to urge the latching ratchet to the unlatched position when in the released position;

an intermediate cable extending between the latches, wherein the intermediate cable is adapted to move the latching ratchet of the auxiliary latch to the unlatched position in response to the latching ratchet of the master latch moving to the unlatched position; and a master release cable operatively coupled at a distal end of the master release cable to the pawl of the master latch assembly and adapted to move the pawl of the master latch assembly to release the latching ratchet to the unlatched position when the master release cable is actuated.

9. The dual hood latch assembly of claim 8 further comprising an intermediate release cable having a first end and a second end, the intermediate release cable being coupled at the second end to the pawl of the auxiliary latch assembly and adapted to move the pawl of the auxiliary latch assembly to release the latching ratchet of the auxiliary latch assembly to the unlatched position when the intermediate release cable is actuated.

10. The dual hood latch mechanism of claim 8 further comprising an auxiliary release lever rotatably mounted on the master latch assembly and movable between a latched position and an unlatched position, the auxiliary release lever having a toggle end disposed adjacent to and adapted for selective displacement by a portion of the latching ratchet of the master latch assembly, a second end attached to the first end of the intermediate release cable, and a release lever resilient member urging the auxiliary release lever to the latched position, wherein movement of the latching ratchet of the master latch assembly to the unlatched position rotates the auxiliary release lever to the unlatched position to actuate the intermediate release cable.

11. The dual hood latch assembly of claim 8 further comprising an occupant compartment and a master release handle disposed within the occupant compartment coupled to the master release cable for actuating the master release cable and unlatching the master latch.

12. The dual hood latch assembly of claim 8, wherein each of the master latch and the auxiliary latch comprise a spring urging each of the latching ratchets to the unlatched position when the master release handle is actuated.

13. The dual hood latch assembly of claim 12, wherein the spring comprises a torsion spring having a center spring coil, an upper leg extending from an upper portion of the center spring coil and a lower leg extending from a lower portion of the center spring coil.

14. The dual hood latch assembly of claim 13, wherein each of the latching ratchet of the master and auxiliary latches further comprise a latch engagement stud mounted to the latching ratchet for engagement with one of the legs of the torsion spring and a latch pivot bolt about which the latching ratchet rotates and about which the coil spring is mounted, wherein activation of the master release handle releases the latching ratchet of the master latch and actuation of the intermediate cable releases the primary latching ratchet of the auxiliary latch assembly.

* * * * *